US012281474B2

(12) United States Patent
Kogure et al.

(10) Patent No.: US 12,281,474 B2
(45) Date of Patent: Apr. 22, 2025

(54) EAVES GUTTER

(71) Applicant: SEKISUI HOUSE, LTD., Osaka (JP)

(72) Inventors: Yuto Kogure, Osaka (JP); Hiroki Yamaguchi, Osaka (JP); Hirokazu Miyachi, Osaka (JP); Sachiko Nagahara, Osaka (JP); Yasuaki Takahashi, Osaka (JP); Shohei Kimura, Osaka (JP); Takahiro Suezawa, Osaka (JP)

(73) Assignee: SEKISUI HOUSE, LTD., Osaka (JP)

( * ) Notice: Subject to any disclaimer, the term of this patent is extended or adjusted under 35 U.S.C. 154(b) by 186 days.

(21) Appl. No.: 18/006,795

(22) PCT Filed: Jul. 15, 2021

(86) PCT No.: PCT/JP2021/026641
§ 371 (c)(1),
(2) Date: Jan. 25, 2023

(87) PCT Pub. No.: WO2022/070555
PCT Pub. Date: Apr. 7, 2022

(65) Prior Publication Data

US 2023/0323670 A1 Oct. 12, 2023

(30) Foreign Application Priority Data

Sep. 30, 2020 (JP) ..... 2020-164839

(51) Int. Cl.
*E04D 13/064* (2006.01)

(52) U.S. Cl.
CPC ..... *E04D 13/064* (2013.01)

(58) Field of Classification Search
CPC ..... E04D 13/064; E04D 13/0725
(Continued)

(56) References Cited

U.S. PATENT DOCUMENTS 5,575,118 A * 11/1996 Vahldieck ..... E04D 13/076 52/12
5,640,809 A * 6/1997 Iannelli ..... E04D 13/076 52/12

(Continued)

FOREIGN PATENT DOCUMENTS

JP 1991-18321 2/1991
JP 1992-76844 7/1992

(Continued)

OTHER PUBLICATIONS

International Search Report issued in application No. PCT/JP2021/026641.

*Primary Examiner* — James M Ference
(74) *Attorney, Agent, or Firm* — McClure, Qualey & Rodack, LLP

(57) ABSTRACT

An eaves gutter includes an eaves body formed by bottom, front walls and rear walls, the eaves body being formed as a recessed groove with an upper part thereof longitudinally opening along an eaves edge; and a rising part above the eaves body along the longitudinal direction of the eaves body, wherein the outer surface of the front wall disposed on the outdoor side is an inclined surface inclined obliquely downward from the outdoor side toward the indoor side; and the rising part includes: a rising wall with an outer surface formed as an inclined surface inclined obliquely upward toward the indoor side from a position withdrawn on the indoor side in the horizontal direction relative to the outdoor-side end of the front wall; and a projecting part projecting toward the outdoor side from the upper end of the rising wall along the longitudinal direction of the rising wall.

4 Claims, 3 Drawing Sheets

(58) Field of Classification Search
USPC ..... 52/11
See application file for complete search history.

(56) References Cited

U.S. PATENT DOCUMENTS

| | | | | | |
|---|---|---|---|---|---|
| 5,737,879 | A * | 4/1998 | Sweet | E04D 13/076 | 52/12 |
| 5,845,435 | A * | 12/1998 | Knudson | E04D 13/076 | 248/48.1 |
| 6,412,228 | B1 * | 7/2002 | Meckstroth | E04D 13/076 | 52/12 |
| 6,732,477 | B1 * | 5/2004 | Richard | E04D 13/076 | 52/12 |
| 6,823,630 | B2 * | 11/2004 | Marra | E04D 13/076 | 52/12 |
| 7,730,672 | B2 * | 6/2010 | Knudson | E04D 13/076 | 52/12 |
| 8,176,687 | B2 * | 5/2012 | Roque Alonso | E04D 13/0641 | 52/12 |
| 2002/0073631 | A1 * | 6/2002 | Baker | E04D 13/0725 | 52/12 |
| 2002/0166290 | A1 * | 11/2002 | Bergeron | E04D 13/076 | 52/12 |
| 2003/0029129 | A1 * | 2/2003 | Walters | E04D 13/064 | 52/12 |
| 2004/0244304 | A1 * | 12/2004 | Bullinger | E04D 13/064 | 52/12 |
| 2005/0082436 | A1 * | 4/2005 | Snell | E04D 13/0725 | 248/48.2 |
| 2005/0115158 | A1 * | 6/2005 | Brown | E04D 13/0641 | 52/11 |
| 2007/0094940 | A1 * | 5/2007 | Pijanowski | E04D 13/064 | 52/12 |
| 2007/0119104 | A1 * | 5/2007 | Pijanowski | E04D 13/064 | 52/11 |
| 2008/0000169 | A1 * | 1/2008 | Handley | B29C 48/0022 | 52/12 |
| 2008/0120920 | A1 * | 5/2008 | Knudson | E04D 13/0725 | 52/12 |
| 2009/0019786 | A1 * | 1/2009 | Bachman | E04D 13/076 | 52/12 |
| 2010/0242376 | A1 * | 9/2010 | Dowling | E04D 13/076 | 52/12 |
| 2011/0114800 | A1 * | 5/2011 | Gramling | E04D 13/0727 | 52/12 |
| 2011/0126477 | A1 * | 6/2011 | Hurn | E04D 13/076 | 52/12 |
| 2023/0323670 | A1 * | 10/2023 | Kogure | E04D 13/064 | 52/11 |

FOREIGN PATENT DOCUMENTS

| | | | |
|---|---|---|---|
| JP | H0842084 | A * | 2/1996 |
| JP | 1996-326240 | | 12/1996 |
| JP | 1999-62131 | | 3/1999 |
| JP | H1162131 | A * | 3/1999 |
| JP | 2000136606 | A * | 5/2000 |
| JP | 2001-12029 | A | 1/2001 |
| JP | 2001012029 | A * | 1/2001 |
| JP | 2009-30300 | A | 2/2009 |
| JP | 2011214296 | A * | 10/2011 |
| JP | 2014058787 | A * | 4/2014 |

* cited by examiner

[Fig.1]
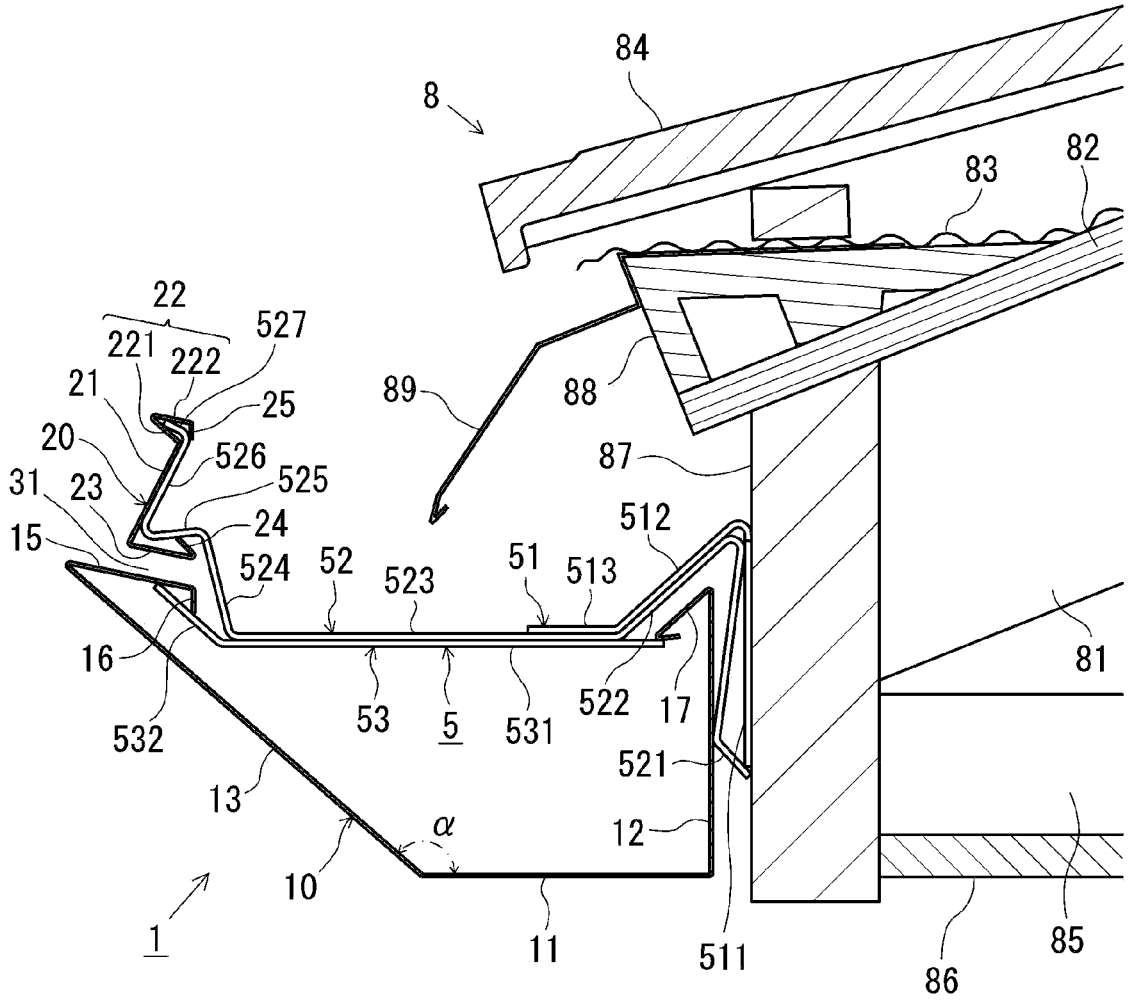

[Fig.2]
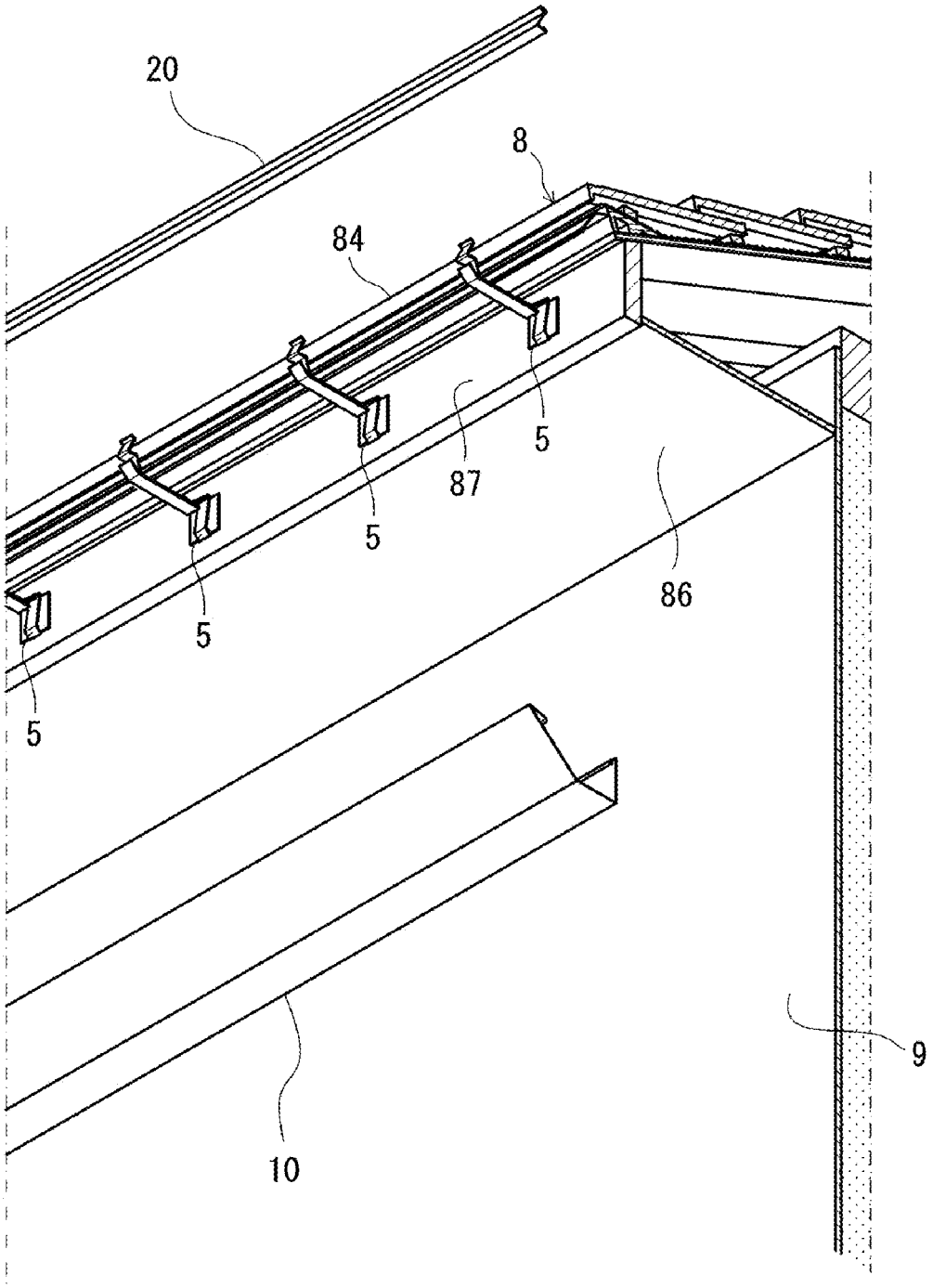

[Fig.3]
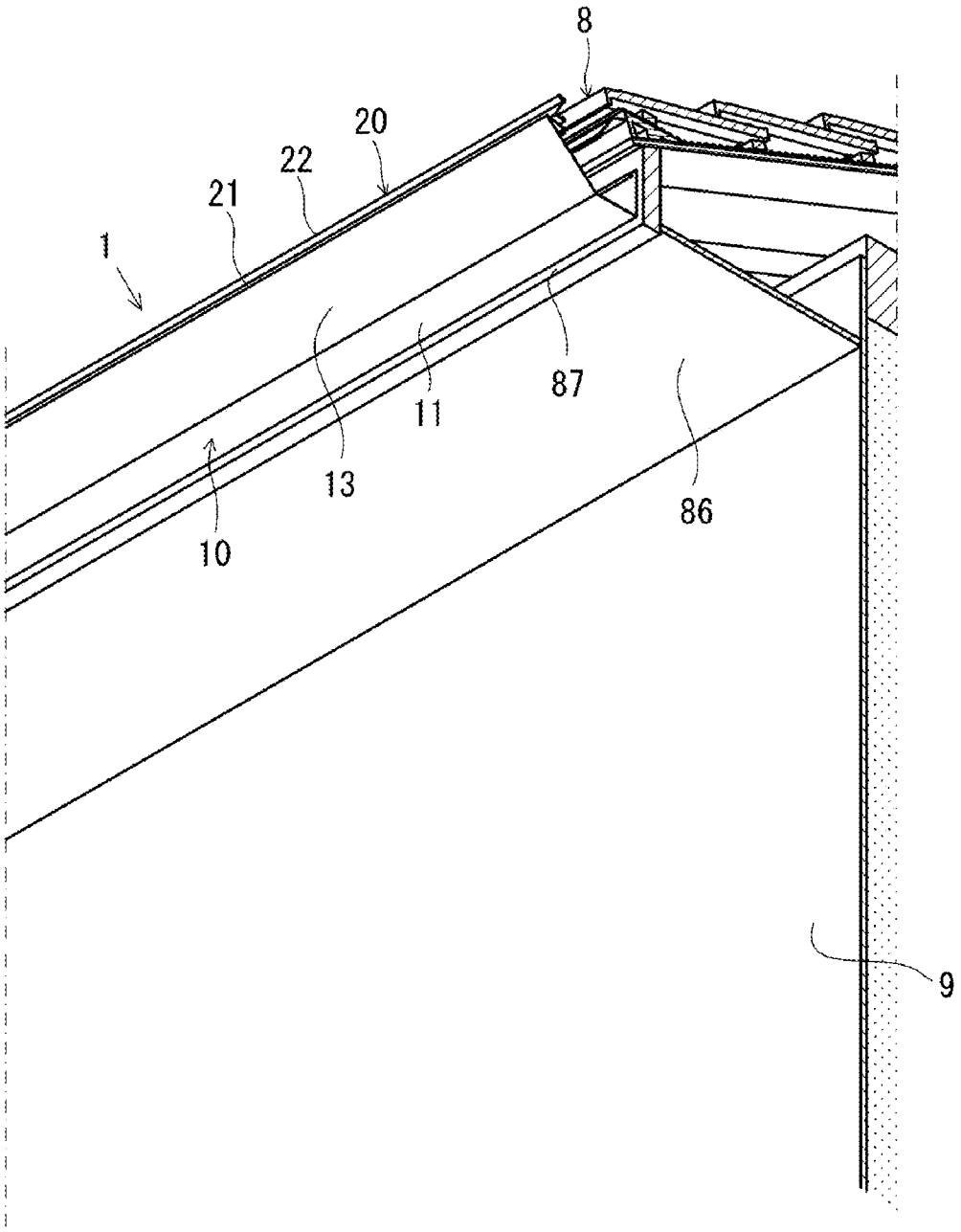

EAVES GUTTER

TECHNICAL FIELD

The present invention relates to a gutter, which is a device for collecting rainwater falling on a roof of a building, such as a house, and draining it to the ground or to a sewer, specifically to an eaves gutter attached to an eaves edge.

BACKGROUND ART

Generally, a building, such as a house, is provided with a gutter, which is a device for collecting rainwater falling on the roof and draining it to the ground or to a sewer. A gutter is mainly constituted of an eaves gutter, which is provided to extend horizontally along the eaves edge and receives and collects rainwater flowing down from the roof, and a vertical gutter, which is provided to extend in the longitudinal direction downward from the eaves gutter and carries the rainwater collected by the eaves gutter down to the ground or a sewer.

A gutter is installed on the exterior of a building and serves as a component constituting the appearance of the building. The appearance of a building is an important element that influences the impression of the building itself, as well as the surrounding landscape, and thus may even affect the value of the building. For example, when a house is on sale, it is highly likely that the consumer values the appearance of the house in deciding whether or not to purchase the house.

Among the two gutters, the vertical gutter can often be hidden or made less visible from the view from the outside by devising specific installation so that it resides in an inconspicuous location, such as at a corner of an end of the exterior wall, or at the rear side, the lateral side, or the like of the building that is less visible from the front side of the building. However, since the eaves gutter is provided to extend horizontally along the eaves edge on the roof, it is often difficult to hide it from the view from the outside. For example, in the case of a building having a hipped roof with roof surfaces inclined in four directions, eaves edges are usually formed in four directions around the building, and the eaves gutters are also provided to surround the circumference of the building; consequently, the eaves gutters are unavoidably located in a place visible from the outside. As explained, for an eaves gutter, the design of its appearance is important in addition to the performance of draining rainwater falling from the roof, because the appearance of the eaves edge or even the building as a whole can be either deteriorated or improved depending on the eaves gutter.

An eaves gutter is generally formed in the shape of a recessed groove with an upper part thereof opening, so that rainwater flowing down from the roof is received into the recessed groove through the opening in the upper part, and then the rainwater received into the recessed groove serving as a channel is flowed to a location to where the vertical gutter is connected. In the conventional eaves gutter, the outdoor side wall and the indoor side wall of the recessed groove have substantially equal heights. Therefore, when the eaves gutter is formed on the eaves edge, the eaves portion of the roof becomes visible when seen from below, thus deteriorating the appearance. To solve this problem, it has been proposed to provide a standing piece that rises obliquely upward from the upper end of the outdoor side wall of the recessed groove of the eaves gutter toward the roof side (see, for example, Patent Literatures 1 and 2). These documents also disclose that, by providing such a standing piece, it is possible to hide the eaves edge part of the roof by the standing piece and also allows integration with the roof to improve the appearance, and it is also possible to substantially match the slope of the standing piece with the slope of the roof to improve the appearance. In addition, an eaves gutter in which the standing piece is formed separately from the outdoor side wall and a rainwater inflow gap is provided between the standing piece and the outdoor side wall has also been proposed (see, for example, Patent Literature 3).

CITATION LIST

Patent Literatures

Patent Literature 1: JP H03-018321 U
Patent Literature 2: JP H04-076844 U
Patent Literature 3: JP H08-326240 A

SUMMARY OF THE INVENTION

Technical Problems

In the eaves gutters disclosed in Patent Literatures 1-3 described above, the outdoor side wall of the recessed groove of the eaves gutter is formed in a planar shape rising substantially vertically or in a curved surface shape being convex to the outdoor side, and also the standing piece is provided to extend obliquely upward from the upper end of the outdoor side wall toward the roof at a slope substantially equal to that of the roof, so that the eaves gutter is hidden by the standing piece and a sense of integration with the roof can be imparted. However, as described in Patent Literature 3, the outdoor side wall protrudes toward the outdoor side, and gives the eaves edge a sense of volume in its appearance. However, in recent years, the exterior design of buildings has diversified, and even for eaves edges, an appearance that gives a sharp and clean impression is often preferred, and the eaves gutter, which gives a sense of volume as described in Patent Literatures 1-3, did not meet such a demand.

The present invention was made in view of the above circumstances, and an object thereof is to provide an eaves gutter that can impart sharpness to the eaves edge of a building to improve its appearance.

Solutions to Problems

To solve the above problem, an eaves gutter according to the present invention is attached along an eaves edge of a building to receive and drain rainwater flowing down from the top end of the roof on the eaves edge. The eaves gutter of the present invention includes an eaves body formed by a bottom wall, and a front wall and a rear wall raising with the bottom wall interposed therebetween, the eaves body being formed in a shape of recessed groove with its upper part longitudinally opening along the eaves edge, and a rising part provided above the eaves body along the longitudinal direction of the eaves body, wherein an outer surface of the front wall of the eaves body disposed on an outdoor side is formed as an inclined surface inclined obliquely downward from the outdoor side toward an indoor side; and the rising part includes a rising wall with an outer surface, which is formed as an inclined surface inclined obliquely upward toward the indoor side from a position withdrawn on the indoor side in the horizontal direction relative to an outdoor-side end of the front wall, and a projecting part provided projecting toward the outdoor side from the upper end of the rising wall along the longitudinal direction of the rising wall.

Preferably, the eaves gutter according to the present invention is characterized in that the projecting part has a projecting part upper surface inclined obliquely downward from a projecting end of the projecting part toward the indoor side.

Preferably, the eaves gutter according to the present invention is characterized in that the eaves body and the rising part are structured as separate components, and in that, when the eaves body and the rising part are attached to the eaves edge, a slit is formed between the eaves body and the rising part to introduce rainwater into the recessed groove of the eaves body.

Preferably, the eaves gutter according to the present invention is characterized in that an angle of inclination of the outer surface of the rising wall with respect to a horizontal plane is greater than an angle of inclination of the roof with respect to the horizontal plane.

Advantageous Effects of the Invention

An eaves gutter according to the present invention is attached along an eaves edge of a building to receive and drain rainwater flowing down from the top end of the roof on the eaves edge. The eaves gutter of the present invention includes an eaves body formed by a bottom wall, and a front wall and a rear wall raising with the bottom wall interposed therebetween, the eaves body being formed in a shape of recessed groove with its upper part longitudinally opening along the eaves edge, and a rising part provided above the eaves body along the longitudinal direction of the eaves body, wherein an outer surface of the front wall of the eaves body disposed on an outdoor side is formed as an inclined surface inclined obliquely downward from the outdoor side toward an indoor side; and the rising part includes a rising wall with an outer surface, which is formed as an inclined surface inclined obliquely upward toward an indoor side from a position withdrawn on the indoor side in the horizontal direction relative to an outdoor-side end of the front wall, and a projecting part provided projecting toward the outdoor side from the upper end of the rising wall along the longitudinal direction of the rising wall. Since the eaves body attached to the eaves edge is structured such that the outer surface of the front wall disposed on the outdoor side is formed as an inclined surface inclined obliquely downward toward the indoor side and leads to a lower surface of the bottom wall, it is possible to impart a sharp impression in which the outer surface of the front wall is planar and the boundary thereof with the lower surface of the bottom wall is linear, as well as a clean impression with a reduced sense of protrusion of the front wall toward the outdoor side, to the appearance of the eaves edge by the eaves body, thus improving the appearance of the eaves edge. The rising part is provided above the eaves body, and the rising part can hide the part of the eaves edge that cannot be hidden by the eaves body. Further, since the outer surface of the rising wall of the rising part is formed as an inclined surface inclined obliquely upward toward the indoor side from a position horizontally withdrawn on the indoor side relative to the outdoor-side end of the front wall of the eaves body, it is possible to reduce the sense of protrusion of the rising wall toward the outdoor side and improve the appearance of the eaves edge. In addition, the rising part has the projecting part that projects toward the outdoor side from the upper end of the rising wall. The projecting part accentuates the appearance, and the shadow formed by the projecting part can further improve the appearance of the eaves edge.

Preferably, the eaves gutter according to the present invention is characterized in that the projecting part has a projecting part upper surface inclined obliquely downward from a projecting end of the projecting part toward the indoor side. When it rains, although the rising part located above the eaves body gets wet, since the projecting part is located on the upper end of the rising part, and the presence of the projecting part reduces the degree of wetting of the portion of the rising part below the projecting part compared with the case where the projecting part is not provided; further, since the projecting part upper surface is inclined toward the indoor side, rain falling on the projecting part can flow along the inclination of the projecting part upper surface toward the indoor side and fall into the recessed groove through the upper opening of the eaves body, the amount of rainwater that soaks the outdoor side of the rising part can be reduced.

Preferably, the eaves gutter according to the present invention is characterized in that the eaves body and the rising part are structured as separate components, and in that, when the eaves body and the rising part are attached to the eaves edge, a slit is formed between the eaves body and the rising part to introduce rainwater into the recessed groove of the eaves body. Therefore, even when it rains and the outer surface of the rising wall of the rising part gets wet, rainwater dripping from the rising wall can flow through the slit between the eaves body and the rising part into the recessed groove of the eaves body, thereby preventing rainwater in the rising part from flowing to the outdoor side of the eaves body and wetting the outer surface of the eaves body or the eaves edge. In addition, since the outer surface of the eaves body is less likely to get wet, it is possible to prevent stains of rain drops that degrade the designability.

Preferably, the eaves gutter according to the present invention is characterized in that an angle of inclination of the outer surface of the rising wall with respect to a horizontal plane is greater than an angle of inclination of the roof with respect to the horizontal plane; therefore, compared with the case where the outer surface of the rising wall is provided in accordance with the slope of the roof, a larger area of the eaves edge can be hidden by the rising wall if the outer surface of the rising wall has the same width.

BRIEF DESCRIPTION OF THE DRAWINGS

FIG. 1 is a cross-sectional side view of an eaves edge in which an eaves gutter is provided according to one embodiment of the present invention.

FIG. 2 is a cross-sectional perspective view illustrating the appearance of the eaves edge before the eaves gutter is provided according to one embodiment of the present invention.

FIG. 3 is a cross-sectional perspective view of the appearance of the eaves edge after the eave gutter is provided according to one embodiment of the present invention.

DESCRIPTION OF EMBODIMENTS

One embodiment of an eaves gutter of the present invention is described below with reference to the drawings. However, the following is only an illustrative example of one embodiment of the invention, and the scope of the present invention is not limited only to the following embodiment, but can be modified as necessary without departing from the spirit of the present invention.

An eaves gutter 1 according to one embodiment of the present invention is provided along an eaves edge 8 of the roof of a building, such as a house, as shown in FIGS. 1 to 3. Generally, a roof of a house is formed as an inclined roof in which a roof surface is inclined to improve drainage to prevent leaks and the like. Rainwater falling on the roof will flow downward along the inclination of the roof surface and fall from the top end portion of the roof to the ground. If rainwater is allowed to fall directly from the roof to the ground, it may cause various problems such as noise due to the impact of water landing, softening of the ground due to holes or puddles created in the ground by the impact of water landing, contamination of the exterior wall or the like due to mud splashing, and the like. Therefore, rainwater that falls on the roof must be drained properly. The eaves gutter 1 is provided in the eaves edge 8, which is the top end portion of such a roof, to receive rainwater flowing down from the top end portion of the roof, thereby preventing the rainwater from falling directly from the roof to the ground. The rainwater received by the eaves gutter 1 at the eaves edge 8 is collected by the eaves gutter 1 to a predetermined point to be drained to a drain port, a sewer, or the like provided on the ground via a vertical gutter extending in the longitudinal direction while being connected to the eaves gutter 1 at that point.

In the present embodiment, the eaves edge 8 in which the eaves gutter 1 is provided is structured as shown in FIG. 1. The roof of the present embodiment is an inclined roof having an inclined roof surface, and includes a plurality of rafters 81 that are provided substantially in parallel with each other while being inclined obliquely downward from the ridge part. A sheathing roof board 82 and a waterproof material 83 are laid on these rafters 81 to form a roof base, and a roof material 84 is installed over the roof base via pantiles, and the like. As shown in FIG. 2, a lower part of the roof protrudes to the outdoor side beyond an exterior wall 9 to form an eave, and the top end portion in the outdoor side of the eave, i.e., the top end portion of the lower end of the roof, forms the eaves edge 8. In the eaves of the present embodiment, an eaves soffit material 86 is provided below the rafters 81 via a ceiling joist 85, and the lower surface of the eaves soffit material 86 forms a rear eaves ceiling that extends horizontally from the exterior wall 9 to the eaves edge 8.

In the eaves edge 8, a fascia board 87 that extends horizontally along the eaves edge 8 is provided. The fascia board 87 is a strip-shaped plate member that hides a wood edge at the top end of the rafters 81, the ceiling joist 85, and the like, from the view from the outside, and also is used as a base for attaching the eaves gutter 1. As shown in FIGS. 1 and 2, in the present embodiment, the fascia board 87 is provided so that the outer surface in the outdoor side forms a substantially vertical plane. Note that in the following, unless otherwise specified, the horizontal direction refers to the horizontal direction in the cross section perpendicular to the longitudinal direction of the eaves edge 8, i.e., the direction that extends to left and right in FIG. 1. In addition, the outdoor side refers to the outdoor side in the horizontal direction, and the indoor side refers to the indoor side in the horizontal direction.

In the eaves edge 8 of the present embodiment, the wood edge of the top end of the rafters 81 are formed as a substantially vertical plane, the fascia board 87 is attached to the top ends of the rafters 81, the sheathing roof board 82, which is laid on the upper surfaces of the rafters 81, covers up to the upper part of the fascia board 87, a tilting board 88 is provided on the upper surface at the outdoor-side end of the sheathing roof board 82, and the waterproof material 83 is laid to cover up to the tilting board 88, with the roof material 84 covering all over them. Thus, the outer surface in the outdoor side of the fascia board 87 is positioned below the roof material 84 while being withdrawn on the indoor side relative to the top end of the roof material 84.

The eaves gutter 1 is attached to such an eaves edge 8, and includes an eaves body 10 having the primary function as the eaves gutter 1 to receive and collect rainwater from the roof, and a rising part 20 mainly having a function of hiding the eaves edge 8 from the view from the outside. In the eaves gutter 1 according to the present embodiment, the eaves body 10 and the rising part 20 are structured as separate components.

As shown in FIG. 1, the eaves body 10 according to the present embodiment has a substantially rectangular bottom wall 11, a rear wall 12 rising substantially vertically upward from one of the long sides of the bottom wall 11, a front wall 13 rising obliquely upward from the other long side of the bottom wall 11 in the opposite direction to the rear wall 12. The three sides of the eaves body 10 are surrounded by the bottom wall 11, and the rear and front walls 12 and 13 respectively rising from a pair of long sides of the bottom wall 11 with the bottom wall 11 interposed therebetween, thus forming a recessed groove with its upper part longitudinally opening. The eaves body 10 is attached along the fascia board 87 of the eaves edge 8 so that the bottom wall 11 thereof comes on the bottom, the rear wall 12 faces the fascia board 87, and the front wall 13 is positioned on the outdoor side. With the eaves body 10 attached at the eaves edge 8, the horizontal position of the top end of the roof material 84 is between the horizontal position of the upper end of the rear wall 12 and the horizontal position of the upper end of the front wall 13. Accordingly, rainwater flowing down from the top end of the roof material 84 is received inside of the recessed groove through its upper opening by the eaves body 10.

As shown in FIG. 1, a flashing board 89 may be provided in the eaves edge 8. The flashing board 89 is a member for preventing rainwater flowing down from the top end of the roof material 84 from moving to the indoor side and wetting the rear eaves ceiling, the exterior wall 9, and the like. In the present embodiment, the flashing board 89 is provided along the eaves edge 8, extending obliquely downward to the outdoor side from the tilting board 88. The horizontal location of the lower end of the flashing board 89 is between the horizontal location of the upper end of the rear wall 12 and the horizontal location of the upper end of the front wall 13 of the eaves body 10, so that rainwater flowing down from the flashing board 89 also falls into the recessed groove through the upper opening of the eaves body 10.

The rainwater received into the recessed groove of the eaves body 10 becomes to flow through the recessed groove of the eaves body 10 serving as a channel to a predetermined point where the vertical gutter is connected to the eaves body 10. With the eaves body 10 attached at the eaves edge 8, a hydraulic gradient is provided into the recessed groove of the eaves body 10 along the eaves edge 8 so that the rainwater flows through the recessed groove of the eaves body 10 serving as a channel. In the present embodiment, the eaves body 10 is formed by folding a single thin plate-shaped member; therefore, if the cross-sectional shape of the recessed groove of the eaves body is constant in the longitudinal direction as in the present embodiment, a hydraulic gradient can be provided by obliquely attaching the eaves body 10 itself along the eaves edge 8. In this case, in terms of the appearance, the eaves body 10 is preferably attached so that the lower surface of the bottom wall 11 is as close to substantially horizontal along the eaves edge 8 as possible, while ensuring a hydraulic gradient that allows for the required drainage capacity.

In the present embodiment, with the eaves body 10 attached at the eaves edge 8, the height position of the upper end of the rear wall 12 is approximately equal to the height position of the upper end of the front wall 13, and the top edge of the outer surface of the front wall 13 is located horizontally at the most outdoor side and vertically at the most upper side of the eaves body 10. Although the eaves body 10 may be formed so that either the upper end of the rear wall 12 or the upper end of the front wall 13 is higher, in this case, water can only be pooled in the recessed groove of the eaves body 10 up to the lower one of the upper end of the rear wall 12 and the upper end of the front wall 13. Therefore, after the rear wall 12 and the front wall 13 are formed at a height that can ensure the necessary water receiving capacity in the recessed groove, one of them needs to be further made higher than the other. The portion thus made higher is considered an unnecessary portion in terms of the function as a recessed groove of the eaves body 10. Therefore, in terms of reducing the material cost of the eaves body 10, it is preferable to make the height positions of the upper end of the rear wall 12 and the upper end of the front wall 13 substantially equal.

Since the eaves edge 8 is usually provided at a higher position than the eye level position of an ordinary person, the view from the outside to the eaves body 10 attached to the eaves edge 8 is as if looking up from the lower or obliquely lower of the outdoor side. Thus, the two flat planes, i.e., the lower surface of the bottom wall 11, which is a substantially horizontal plane, and the outer surface of the front wall 13, which is an inclined surface extending obliquely upward toward the outdoor side from the bottom wall 11, as well as a straight line formed at the boundary between the lower surface of the bottom wall 11 and the outer surface of the front wall 13, can be seen from the outside as the appearance of the eaves body 10 attached to the eaves edge 8. As described above, the appearance of the eaves body 10 is formed of flat planes and straight lines, thus imparting sharpness to the eaves edge 8; further, since the front wall 13 has an inclined surface that is inclined obliquely downward to be withdrawn to the indoor side from the outdoor side, the sense of protrusion of the front wall 13 to the outdoor side can be reduced, thus achieving a clear impression of the eaves edge 8. Herein, angle $\alpha$ formed by the lower surface of the bottom wall 11 and the outer surface of the front wall 13 is larger than 90 degrees and smaller than 180 degrees. If the angle $\alpha$ is made closer to 90 degrees, the outer surface of the front wall 13 becomes substantially vertical, and the sense of protrusion to the outdoor side due to the front wall 13 is enhanced. On the other hand, if the angle $\alpha$ is made closer to 180 degrees, the depth of the recessed groove of the eaves body 10 becomes smaller and the required water receiving capacity of the recessed groove cannot be ensured. Therefore, the angle $\alpha$ is preferably, but not limited to, near 135 degrees, which is a value between 90 and 180 degrees, namely in the range of 120 to 150 degrees and more preferably in the range of 130 to 140 degrees.

In the present embodiment, a horizontal rear eaves ceiling is formed by the eaves soffit material 86 in the eaves including the eaves edge 8, and the eaves body 10 is preferably installed so that the height position of the lower surface of the bottom wall 11 is approximately equal to the height position of the lower surface of the eaves soffit material 86. Alternatively, if the lower surface of the fascia board 87 is installed to project more downward than the lower surface of the eaves soffit material 86, the height position of the lower surface of the bottom wall 11 may be matched with the height position of the lower surface of the fascia board 87. Before the eaves body 10 is attached, the eaves edge 8 has an appearance having many irregularities between the rear eaves ceiling and the roof, as the vertical plane of the fascia board 87 rises from the horizontal rear eaves ceiling of the eaves soffit material 86, and the top end portion of the roof material 84 projects from the fascia board 87 to the outdoor side with the sheathing roof board 82, the tilting board 88, and the like interposed therebetween. By attaching the eaves body 10 to such an eaves edge 8, the irregularities of the eaves edge 8 can be hidden; further, the two flat planes, i.e., the bottom wall 11 extending from the rear eaves ceiling to the outdoor side while being in flush with the rear eaves ceiling, and the front wall 13 extending from the extension end of the bottom wall 11 obliquely upward toward the outdoor side, create an integrated appearance the rear eaves ceiling is continuously connected to the roof.

The rising part 20 is provided above the eaves body 10, extending along the longitudinal direction of the eaves body 10. The rising part 20 includes a rising wall 21 with an inclined outer surface rising obliquely upward, and a projecting part 22 projecting from the upper end of the rising wall 21 along the longitudinal direction of the rising wall 21. In the present embodiment, as shown in FIGS. 2 and 3, the rising part 20 is structured as a separate component from the eaves body 10 and is attached to the eaves edge 8 together with the eaves body 10.

With the eaves gutter 1 attached to the eaves edge 8, the rising part 20 is positioned above the eaves body 10. However, since the eaves body 10 is formed in a shape of a recessed groove with an upper part thereof opening and receives rainwater flowing down from the top end of the roof material 84 into the recessed groove through the upper opening, the rising part 20 is placed near the outdoor-side end of the eaves body 10 to prevent itself from blocking the opening in the upper part of the eaves body 10 as much as possible. However, if the rising part 20 is positioned more closer to the outdoor side than the eaves body 10, the eaves edge 8 may look more protruded to the outdoor side due to the presence of the rising part 20, and dirt due to rain drops may be generated. Therefore, the position of the rising part 20 in the outdoor-side end is withdrawn on the indoor side relative to the outdoor-side end of the eaves body 10. The outdoor-side end of the eaves body 10 refers to the top edge of the outer surface of the front wall 13. The outdoor-side end of the rising part 20 refers to the bottom edge of the outer surface of the rising wall 21, and the outer surface of the rising wall 21 forms an inclined surface that rises obliquely upward toward the indoor side from the bottom edge thereof disposed in a position withdrawn on the indoor side relative to the outdoor-side end of the eaves body 10 near the outdoor-side end of the eaves body 10. Further, the projecting part 22 is provided to project to the outdoor side from the top edge of the outer surface of the rising wall 21, and extends along the longitudinal direction of the rising wall 21. The projecting part 22 has its projecting end at the upper end of the rising part 20. Also, the horizontal position of the projecting end of the projecting part 22 is structured so as not to go beyond the horizontal position of the bottom edge of the outer surface of the rising wall 21. In the present embodiment, the projecting part 22 includes a projecting part lower surface 221 extending obliquely upward to the outdoor side from the top edge of the outer surface of the rising wall 21, and a projecting part upper surface 222 extending obliquely downward toward the indoor side from the extension end side of the projecting part lower surface 221. These projecting part lower surface 221 and projecting part upper surface 222 create a substantially mountainous shape in cross section. The extension end side of the projecting part lower surface 221 forms the projecting end of the projecting part 22, and the extension end side of the projecting part upper surface 222 forms the indoor-side end of the projecting part 22.

By providing the eaves gutter 1 having such a rising part 20 in the eaves edge 8, the parts in the eaves edge 8 which are not desirable to be seen from the outside, i.e., the upper part of the fascia board 87, the ends of the sheathing roof board 82, the waterproof material 83, the tilting board 88, etc. between the fascia board 87 and the top end of the roof material 84, the flashing board 89, and the like, can be hidden by the rising part 20 from the view from the outside even when they cannot be completely hidden only by the installation of the eaves body 10.

Further, in the rising part 20, the bottom edge of the outer surface of the rising wall 21, which forms the horizontal outdoor-side end of the rising part 20, is provided in a position withdrawn on the indoor side relative to the outdoor-side end of the eaves body 10 in the horizontal direction, and the outer surface of the rising wall 21 forms an inclined surface that rises obliquely upward from the bottom edge on the outdoor side in a direction withdrawn toward the indoor side. Therefore, the sense of integration as if connected from the eaves body 10 to the roof can be enhanced by the rising part 20 while reducing the sense of protrusion to the outdoor side to give a clean impression, thereby improving the appearance of the eaves edge 8.

In addition, since the rising part 20 includes the projecting part 22 projecting to the outdoor side from the upper end of the rising wall 21, the projecting part 22 functions as a direct accent on the appearance, and when sunlight enters on the rising part 20, the projecting part 22, located at the upper end of the rising part 20, blocks the sunlight and creates a shadow below it. Since the projecting part 22 linearly extends in the longitudinal direction of the rising part 20, the shadow formed by the incidence of sunlight on the projecting part 22 also forms a strip-shaped shadow that extends in the longitudinal direction of the rising part 20. The width and the color depth of the shadow change depending on the incidence angle and the intensity of the sunlight; therefore, they vary depending on the weather, time, season, and the like. When the rising part 20 is viewed from the outside, the rising part 20 may be covered entirely by the shadow, or no shadow may be formed on the rising part 20. However, when the lower end of the shadow is positioned on the outer surface of the rising wall 21, that is, when the shadow of the projecting end of the projecting part 22 formed by the sunlight is projected onto the outer surface of the rising wall 21, a contrast of light and dark is formed on the appearance of the rising part 20 by a strip-shaped dark area above the position of the lower end of the shadow and a strip-shaped light area below the position of the lower end of the shadow. The projecting part 22 thus creates a contrast of light and dark by a shadow on the appearance of the rising part 20, thus being able to give the eaves edge 8 where the rising part 20 is provided a varied appearance that always arouses interest.

In the present embodiment, in the eaves edge 8, the horizontal position of projecting end of the projecting part 22 is structured so as not to go beyond the horizontal position of the bottom edge of the outer surface of the rising wall 21 to the outdoor side. The closer the horizontal position of the projecting end of the projecting part 22 to the horizontal position of the bottom edge of the outer surface of the rising wall 21, the greater the projection length of the projecting part 22, making the projecting part 22 more stand out in view of the appearance and increasing the size of the shadow formed by the projecting part 22. Conversely, closer the horizontal position of the projecting end of the projecting part 22 to the horizontal position of the top edge of the outer surface of the rising wall 21, the smaller the projection length of the projecting part 22, making the projecting part 22 less stand out in view of the appearance and decreasing the size of the shadow formed by the projecting part 22. The projection length of the projecting part 22 is not limited thereto insofar as it is designed appropriately in consideration of these factors; however, it is preferable that the horizontal position of the projecting end of the projecting part 22 be included in the middle area made by dividing the outer surface of the rising wall 21 into three equal areas in the horizontal direction, and it is more preferable that the horizontal position of the projecting part 22 be located substantially in the center of the outer surface of the rising wall 21 in the horizontal direction. This allows the projecting part 22 in the rising part 20 to be moderately protruded to the outdoor side, and also allows the lower end of the shadow formed by the projecting part 22 to be easily located on the outer surface of the rising wall 21, thus easily creating a contrast of light and dark in the rising part 20.

The eaves gutter 1 according to the present embodiment is attached to the eaves edge 8 using an eaves gutter attaching tool 5. As shown in FIGS. 2 and 3, a plurality of eaves gutter attaching tools 5 are attached spaced by a predetermined intervals in the longitudinal direction of the fascia board 85 of the eaves edge 8, and the eaves gutter 1 is attached to these eaves gutter attaching tools 5 to be attached to the eaves edge 8 via the eaves gutter attaching tools 5.

Each eaves gutter attaching tool 5 according to the present embodiment has an eaves edge fixing part 51, a rising part attaching part 52, and an eaves body attaching part 53.

The eaves edge fixing part 51 has a planar-shaped planar part 511 that is in contact with the outdoor side outer surface of the fascia board 87, an inclined part 512 that curves at an acute angle from the upper end of the planar part 511 and extends obliquely downward to the outdoor side, and a horizontal part 513 that extends from the extension end of the inclined part 512 to the outdoor side in the horizontal direction. Each eaves gutter attaching tool 5 is fixed to the eaves edge 8 by placing the planar part 511 of the eaves edge fixing part 51 against the fascia board 87 of the eaves edge 8 and fixing it with a screw or the like.

The rising part attaching part 52 includes an eaves body holder 521, an inclined part 522 curving at an acute angle from the upper end of the eaves body holder 521 and extending obliquely downward toward the outdoor side, a horizontal part 523 extending from the extension end of the inclined part 522 toward the outdoor side in the horizontal direction, a standing part 524 rising upward from the extension end of the horizontal part 523, a locking part 525 extending from the extension end of the standing part 524 toward the outdoor side, an inclined part 526 curving at an acute angle from the extension end of the locking part 525 and extending obliquely upward toward the indoor side, and a locking piece part 527 extending obliquely upward from the extension end of the inclined part 526 toward the outdoor side. The rising part attaching part 52 is attached to the eaves edge fixing part 51 by placing the upper surfaces of the inclined part 522 and the horizontal part 523 of the rising part attaching part 52 respectively against the lower surfaces of the inclined part 512 and the horizontal part 513 of the eaves edge fixing part 51. The curvature in the curving part of the upper end of the inclined part 522 of the rising part attaching part 52 is greater than the curvature in the curving part of the upper end of the inclined part 512 of the eaves edge fixing part 51, and the eaves body holder 521 extends from the curving part of the inclined part 522 obliquely downward toward the outdoor side so that it is lifted to more outdoor side than the planar part 511 of the eaves edge fixing part 51, and then extends toward the planar part 511 side, thus creating a substantially mountainous shape in cross section.

The eaves body attaching part 53 has a horizontal part 531 extending toward the outdoor side in the horizontal direction and a locking part 532 extending obliquely upward from the extension end of the horizontal part 531 to the outdoor side. The eaves body attaching part 53 is attached to the rising part attaching part 52 and also to the eaves edge fixing part 51 via the rising part attaching part 52 by bringing the upper surface of the horizontal part 531 of the eaves body attaching part 53 into contact with the lower surface of the horizontal part 523 of the rising part attaching part 52. In this state, the inclined part 522 in the indoor side of the horizontal part 523 of the rising part attaching part 52 rises obliquely upward toward the indoor side from its indoor-side end, while the horizontal part 531 of the eaves body attaching part 53 is provided to project toward more indoor side than the indoor-side end of the horizontal part 523 of the rising part attaching part 52, so that the indoor-side end of the horizontal part 531 is positioned below the inclined part 522 of the rising part attaching part 52.

Each of the eaves edge fixing part 51, the rising part attaching part 52, and the eaves body attaching part 53 can be formed by bending a single strip-shaped plate member. The eaves edge fixing part 51, the rising part attaching part 52, and the eaves body attaching part 53 are formed from strip-shaped plate members having substantially the same width; however, the eaves edge fixing part 51 is preferably formed from a strip-shaped plate member in which the portion serving as the planar part 511 is planar protruding toward the width direction to a greater extent than the other portions. Accordingly, when the rising part attaching part 52 is attached to the eaves edge fixing part 51, the planar part 511 of the eaves edge fixing part 51 protrudes toward the width direction to a greater extent than the eaves body holder 521 of the rising part attaching part 52; as a result, the protruding portion of the planar part 511 can be used to fasten the eaves edge fixing part 51 to the fascia board 87 with screws, and the like, making it easy to attach the eaves gutter attaching tools 5 to the fascia board 87.

To enable itself to be attached to such eaves gutter attaching tools 5, in the eaves body 10 according to the present embodiment, the front wall 13 has a water conducting wall 15 extending obliquely downward from the top edge of the front wall 13 toward the rear wall 12 side, and a locking piece 16 extending downward from the extension end of the water conducting wall 15, and the rear wall 12 has a locking part 17 extending obliquely downward from the top edge of the rear wall 12 to the front wall 13 side. As described above, since the water conducting wall 15 and the locking part 17 extend from the upper end of the front wall 13 and the upper end of the rear wall 12, respectively, toward the inside of the recessed groove of the eaves body 10, the width of the opening at the upper part of the recessed groove of the eaves body 10 is reduced by the length of the horizontal extension of the water conducting wall 15 and the locking part 17. However, since the water conducting wall 15 and the locking part 17 are each inclined obliquely downward toward the inside of the recessed groove, rainwater falling on the water conducting wall 15 or the locking part 17 falls into the recessed groove by following their respective inclinations. Therefore, the opening of the recessed groove can be considered to substantially start from the upper end of the front wall 13 to the upper end of the rear wall 12. In addition, the water conducting wall 15 and the locking part 17 do not affect the appearance of the eaves body 10, as they both extend obliquely downward toward the inside of the recessed groove of the eaves body 10.

In the eaves body 10 of the present embodiment, the locking piece 16, the water conducting wall 15, the front wall 13, the bottom wall 11, the rear wall 12, and the locking part 17 are connected in a continuous form, and are formed by bending a single thin plate-shaped member. Preferable examples of such a thin plate-shaped member include a resin-coated metal plate, such as an easily-bendable metal plate having a strength to withstand the weight of water received inside thereof to serve as the eaves body 10 and having a surface coated with a resin to enhance its corrosion resistance, such as a polyvinyl chloride steel plate obtained by coating the surface of a steel plate with a polyvinyl chloride resin. Thus, when the eaves body 10 is formed by bending a single thin plate-shaped member, the processing thereof requires only the bending step, and also the number of parts can be reduced; therefore, the manufacture and management costs can be reduced and the quality can be easily unified compared with the case requiring welding or other processes.

The eaves body 10 is attached to each eaves gutter attaching tool 5, which is attached to the fascia board 87, by inserting the eaves body attaching part 53 into the recessed groove of the eaves body 10 through the upper opening of the recessed groove, so that the lower end portion of the locking piece 16 on the front wall 13 side and the lower end portion of the locking part 17 on the rear wall 12 side are hooked to and engaged with the upper surface of the locking part 532 of the eaves body attaching part 53 and the upper surface in the indoor-side end of the horizontal part 531 of the eaves body attaching part 53, respectively. In this state, a plurality of the eaves gutter attaching tools 5 are installed at gradually varying height positions spaced from each other along the longitudinal direction of the fascia board 87 so that the eaves body 10 has a predetermined hydraulic gradient along the longitudinal direction of the eaves edge 8. The eaves body 10 is thus attached to the eaves edge 8 by being attached to the plurality of the eaves gutter attaching tools 5, thereby creating a predetermined hydraulic gradient.

With the eaves body 10 attached to the eaves gutter attaching tools 5, the eaves body attaching part 53 of the eaves gutter attaching tool 5 is positioned within the recessed groove of the eaves body 10 slightly below the upper end portion of the recessed groove; however, since the adjacent eaves gutter attaching tools 5 are spaced from each other, rainwater flowing down from the roof into the recessed groove of the eaves body 10 is not blocked by the eaves gutter attaching tool 5.

Further, with the eaves body 10 attached to the eaves gutter attaching tools 5, the outer surface of the rear wall 12 comes in contact with a portion having a substantially mountainous shape in cross section of the eaves body holder 521 of the eaves gutter attaching tool 5. This prevents the eaves body 10 from moving toward the indoor side by the presence of the eaves body holder 521 even when wind blows against the eaves body 10 and an external force toward the indoor side is applied to the front wall 13 provided in the outdoor side; therefore, it is possible to prevent the locking part 17 on the rear wall 12 side from coming off from the horizontal part 531 of the eaves body attaching part 53. Since the rear wall 12 faces the fascia board 87 and therefore a force of wind toward the outdoor side is not easily applied to the rear wall 12, the eaves body 10 is less likely to move to the outdoor side due to external forces. Moreover, since the locking part 532 of the eaves body attaching part 53 extends from the outdoor-side end of the horizontal part 531, rising obliquely upward toward the outdoor side, and the locking part 16 on the front wall 13 side is locked by being hooked onto the upper surface of such a locking part 532, the locking piece 16 can be removed and come off from the locking part 532 only when the eaves body 10 moves to the outdoor side in the horizontal direction and also moves upward. Therefore, the locking piece 16 cannot easily come off. As described above, the eaves body 10 can be installed by hooking and locking the locking piece 16 and the locking part 17 from below onto the eaves body attaching part 53 of the eaves gutter attaching tool 5, which is already attached to the eaves edge 8, without requiring any other tools, thereby simplifying the installation. Once the eaves body 10 is attached to the eaves gutter attaching tool 5, the eaves body 10 is not easily detached by natural force and can be firmly attached to the eaves edge 8.

Further, if water from the roof flows into the recessed groove of the eaves body 10 and is stored therein, the downward load from the stored water is applied to the eaves body 10, which is then applied to the eaves body attaching parts 53 of the plurality of the eaves gutter attaching tools 5 to which the eaves body 10 is attached. Each eaves gutter attaching tool 5 is attached to the fascia board 87 by fixing the eaves edge fixing part 51 to the fascia board 87, and the downward load applied to the eaves body attaching part 53 by the eaves body 10 is transmitted through the eaves edge fixing part 51 to which the eaves body attaching part 53 is attached to the fixing part of the eaves edge fixing part 51 and the fascia board 87, and a moment due to the load of the eaves body 10 is generated around the fixing part. Accordingly, the eaves body 10 is made to rotate downward toward the indoor side; however, since the rear wall 12 on the indoor side of the eaves body 10 is in contact with the eaves body holder 521 of the eaves gutter attaching tool 5, the rotation of the eaves body 10 is prevented by the eaves body holder 521. Further, in this state, since the front wall 13 of the eaves body 10 is installed while being inclined obliquely downward from the outdoor side to the indoor side, the center of gravity of the eaves body 10 when water is stored in the recessed groove of the eaves body 10 is located on more indoor side than the horizontal center of the cross section of the recessed groove of the eaves body 10. Accordingly, the magnitude of the moment generated in the fixing part of the eaves edge fixing part 51 and the fascia board 87 is smaller than that in a case where the front wall 13 is installed vertically. This reduces the risk of removal or damages of screws and the like that secure the eaves edge fixing part 51 to the fascia board 87.

The rising part 20 according to the present embodiment is attached to the eaves edge 8 by being attached to the rising part attaching part 52 of the eaves gutter attaching tool 5. In the rising part 20 of the present embodiment, the extension wall 23 extending from the bottom edge of the rising wall 21 and the lower locking piece 24 extending from the extension end of the extension wall 23 are provided in the rising wall 21, and the upper locking piece 25 extending from the extension end of the projecting part upper surface 222 is provided in the projecting part 22. The upper locking piece 25, the projecting part upper surface 222, the projecting part lower surface 221, the rising wall 21, the extension wall 23, and the lower locking piece 24 are connected in a continuous form, and the rising part 20 of the present embodiment is formed by bending a single thin plate-shaped member, as in the eaves body 10.

In the rising part attaching part 52 of the eaves gutter attaching tool 5 attached to the eaves edge 8, the standing part 524 rises upward from the end of the horizontal part 523 horizontally extending toward the outdoor side, and the locking part 525 extends obliquely downward from the upper end of the standing part 524 toward the outdoor side and then is curved; then, the inclined part 526 extends obliquely upward toward the indoor side, and the locking piece part 527 extends obliquely upward toward the outdoor side from the extension end of the inclined part 526. The rising part 20 is attached to the rising part attaching part 52 by fitting the locking piece part 527 between the depression formed by the projecting part lower surface 221 and the projecting part upper surface 222 of the projecting part 22 from the outdoor side with respect to the rising part attaching part 52, fitting the curving part formed between the inclined part 526 and the locking part 526 between the rising wall 21 and the extension wall 23 so that the rising wall 21 comes in contact with the inclined part 526, hooking and locking the lower locking piece 24 provided on the top end of the extension wall 23 onto the locking part 526, and hooking and locking the upper locking piece 25 provided on the top end of the projecting part upper surface 222 onto the corner between the locking piece part 527 and the inclined part 526. The rising part 20 is attached to the eaves edge 8 by being attached to each of the rising part attaching parts 52 of the plurality of eaves gutter attaching tools 5 provided along the longitudinal direction of the fascia board 87.

As described above, the rising part 20 can be installed simply by hooking and locking the lower locking piece 24 and the upper locking piece 25 onto the rising part attaching part 52 of the eaves gutter attaching tool 5, which is already attached to the eaves edge 8, by pressing them against the rising part attaching part 52 from the outdoor side without requiring any other tools, thereby simplifying the installation. In addition, since the eaves body 10 and the rising part 20 are structured as separate components and can be separately detachably attached to the eaves gutter attaching tool 5, the eaves body 10 and the rising part 20 may have different colors as necessary; further, if one of them is damaged, only the damaged one can be replaced.

In the eaves edge 8, the rising part 20 is positioned above the eaves body 10, and the bottom edge of the rising wall 21, which is the outdoor-side end of the rising part 20, is positioned more indoor side in terms of the horizontal direction than the top edge of the front wall 13, which is the outdoor-side end of the eaves body 10. In the present embodiment, the water conducting wall 15 extending obliquely downward from the top edge of the front wall 13 to the indoor side is provided in the eaves body 10, the extension wall 23 extending toward the indoor side from the bottom edge of the rising wall 21 is provided in the rising part 20, and the eaves body 10 and the rising part 20 are disposed in the eaves edge 8 so that the extension wall 23 is inclined obliquely downward to the indoor side to be substantially parallel with the water conducting wall 15 and a slit 31 having a predetermined gap is formed between the extension wall 23 and the water conducting wall 15.

In addition, in the rising part 20 of the present embodiment, the horizontal position of the indoor side-edge of the extension wall 23 and the horizontal position of the indoor-side edge of the projecting part upper surface 222 both serve as the horizontal indoor-side end of the rising part 20 and are disposed to be substantially equal to the horizontal position of the indoor-side edge of the water conducting wall 15 of the eaves body 10. Further, the rising part 20 is disposed above the eaves body 10 within the horizontal width of the water conducting wall 15 of the eaves body 10 so as to prevent itself from blocking the opening of the recessed groove of the eaves body 10.

Since the rising part 20 is disposed above the eaves body 10, when it rains, rain falls also on the rising part 20. In this case, since the projecting part upper surface 222 on the upper end of the rising part 20 is inclined obliquely downward toward the indoor side, rain falling on the rising part 20 first falls on the projecting part upper surface 222, then flows along the inclination of the projecting part upper surface 222 toward the indoor side, and then falls into the opening of the recessed groove of the eaves body 10. The horizontal position of the outdoor-side end of the projecting part upper surface 222, which is the projecting end of the projecting part 22, is positioned more indoor side than the horizontal position of the bottom edge of the rising wall 21; therefore, rain falling between the outdoor-side end of the projecting part upper surface 222 and the bottom edge of the rising wall 21 adheres to the outdoor side outer surface of the rising wall 21. The rising wall 21 is inclined obliquely downward toward the outdoor side, and rainwater adhering to the outdoor side outer surface of the rising wall 21 flows along the slope of the rising wall 21 to the bottom edge of the rising wall 21; the rainwater then either falls onto the water conducting wall 15 of the eaves body 10 below, or flows from the bottom edge of the rising wall 21 toward the lower surface of the extension wall 23, which extends obliquely downward to the indoor side from the bottom edge of the rising wall 21. Herein, the water conducting wall 15 and the extension wall 23 are substantially in parallel with each other with an interval therebetween, and they form the slit 31 extending obliquely downward toward the opening of the recessed groove of the eaves body 10. The rainwater fell on the water conducting wall 15 flows in the slit 31 along the slope of the water conducting wall 15 and falls into the recessed groove through the opening of the recessed groove of the eaves body 10. The rainwater that flows along the lower surface of the extension wall 23 also flows in the slit 31 and falls into the recessed groove through the opening of the recessed groove of the eaves body 10. The rainwater falling between the bottom edge of the rising wall 21 and the top edge of the front wall 13 positioned more outdoor side than the rising wall 21 also first falls on the water conducting wall 15 and then flows along the inclination of the water conducting wall 15, passes through the slit 31, and then falls into the recessed groove of the eaves body 10. Thus, in the eaves gutter 1 according to the present embodiment, even if rainwater falls on the rising part 20, rainwater adhering to the rising part 20 does not fall directly from the rising part 20 to the ground; instead, it flows into the recessed groove of the eaves body 10 and is appropriately drained by the eaves body 10.

Herein, if the gap of the slit 31 is excessively small, the amount of rainwater falling on the outer surface of the rising wall 21 or on the water conducting wall 15 between the bottom edge of the rising wall 21 and the top edge of the front wall 13 is likely to be greater than the amount of the rainwater flowing into the slit 31. As a result, water is pooled in the outdoor side of the slit 31 and there is a risk of overflow of the rainwater to the outdoor side from the upper end of the front wall 13. Therefore, it is necessary to appropriately design the gap of the slit 31 according to the expected amount of rainfall, and the like, so that the rainwater smoothly flows through the slit 31 without being pooled in the outdoor side of the slit 31. The gap of the slit 31 can be changed by changing the vertical position of the rising part 20. The vertical position of the rising part 20 can be changed by changing the height where the standing part 524 of the rising part attaching part 52 rises from the horizontal part 523. However, if the position of the rising part 20 is excessively far upward from the eaves body 10, thus excessively increasing the gap of the slit 31, a space will appear between the rising part 20 and the eaves body 10 in terms of the appearance, and there is a risk of making the tilting board 88, the flashing board 89, and the like, i.e., the parts of the eaves edge 8 that are supposed to be hidden by the rising part 20, visible from the outside via the slit 31. Therefore, the gap of the slit 31 is designed to avoid such a space between the rising part 20 and the eaves body 10 in terms of the appearance.

Further, since the outer surface of the rising wall 21 in the eaves edge 8 is an inclined surface, the angle of inclination of the outer surface of the rising wall 21 with respect to the horizontal plane can be greater than 0 degree and smaller than 90 degrees; however, if the angle is smaller than 45 degrees, the horizontal width of the rising wall 21 becomes greater than the height where it rises upward. Therefore, when the horizontal position of the indoor-side end of the rising part 20 is aligned with the horizontal position of the indoor-side end of the water conducting wall 15 of the eaves body 10, the rising wall 21 may not be high enough to fully hide the eaves edge 8; then, if the height of the rising wall 21 is increased accordingly, the rising part 20 may block the upper opening of the eaves body 10 or there may be a risk of increasing the cost of the rising part 20. On the other hand, when the angle is closer to 90 degrees, the projection length of the projecting part 22 cannot be ensured or the outer surface of the rising wall 21 becomes substantially vertical, thus enhancing the sense of protrusion to the outdoor side. Therefore, the angle of inclination of the outer surface of the rising wall 21 with respect to the horizontal plane is preferably, but not limited to, in the range of 45 to 80 degrees, and more preferably in the range of 55 to 70 degrees. Herein, the slope of an inclined roof of a house is generally a slope between 3-Sun (3/10) and about 6-Sun (6/10), and a slope of 10-Sun (10/10) or more is considered very steep and will hardly be employed. If the slope of the roof is 10-Sun (10/10), the angle of inclination of the roof with respect to the horizontal plane is 45 degrees; therefore, the preferred angle of inclination of the outer surface of the rising wall 21 according to the present embodiment with respect to the horizontal plane is greater than the angle of inclination of the roof with respect to the horizontal plane.

Further, in the eaves body 10, rain falling on more indoor side than the top edge of the front wall 13 is made to flow into the recessed groove of the eaves body 10. Since the outer surface of the front wall 13 is provided inclined obliquely downward from the top edge thereof to be withdrawn on the indoor side, the rain falling on more outdoor side than the top edge of the front wall 13 hits the outer surface of the front wall 13 when the angle of inclination of the outer surface of the front wall 13 with respect to the vertical direction is greater than the angle of inclination of the falling rain with respect to the vertical direction. Such an inclined outer surface of the front wall 3 of the eaves body 10 not only imparts sharpness to the appearance, but also makes it more difficult for rain to adhere to the outer surface of the front wall 13, thus preventing dirt on the outer surface of the front wall 13 due to the raindrops, thereby preventing deterioration of the design. Further, it is also possible to prevent a risk of a large amount of rainwater adhering to the outer surface of the front wall 13, which may further cause the rainwater to flow to the lower surface of the bottom wall 11 and then fall from the bottom wall 11 to the ground or being carried to the rear eaves ceiling or the exterior wall.

As shown above, with the eaves gutter 1 according to the present embodiment, it is possible to impart a sharp and clean impression to the eaves edge 8 of a building to which the eaves gutter 1 is attached, thereby improving the appearance.

DESCRIPTION OF REFERENCE SIGNS

1 eaves gutter
10 eaves body
11 bottom wall
12 rear wall
13 front wall
15 water conducting wall
16 locking piece
17 locking part
20 rising part
21 rising wall
22 projecting part
221 projecting part lower surface
222 projecting part upper surface
28 extension wall
24 lower locking piece
25 upper locking piece
81 slit
5 eaves gutter attaching tool
51 eaves edge fixing part
52 rising part attaching part
53 eaves body attaching part
8 eaves edge
81 rafters
82 sheathing roof board
88 waterproof material
84 roof material
85 ceiling joist
86 eaves soffit material
87 fascia board
88 tilting board
89 flashing board
9 exterior wall

The invention claimed is:

1. An eaves gutter to be attached along an eaves edge of a building to receive and drain rainwater flowing down from a top end of a roof of the eaves edge, the eaves gutter comprising:

an eaves body formed by a bottom wall, and a front wall and a rear wall interposing the bottom wall therebetween and extending upward from the bottom wall, the eaves body being formed in a shape of a recessed groove with an upper part of the eaves body longitudinally opening along the eaves edge; and a rising part provided above the eaves body along a longitudinal direction of the eaves body, wherein an outer surface of the front wall of the eaves body disposed on an outdoor side comprises an inclined surface inclined obliquely downward from the outdoor side toward an indoor side;

the rising part comprises a rising wall with an outer surface comprising an inclined surface inclined obliquely upward toward the indoor side from a position on the indoor side in a horizontal direction relative to an outdoor-side end of the front wall, and a projecting part provided projecting toward the outdoor side from an upper end of the rising wall along a longitudinal direction of the rising wall;

the rising wall is provided with an extension wall extending from a bottom edge of the rising wall;

the projecting part has a projecting part upper surface inclined obliquely downward from a projecting end of the projecting part toward the indoor side;

a horizontal position of an indoor side-edge of the projecting part upper surface and a horizontal position of an indoor-side edge of the extension wall both serve as a horizontal indoor-side end of the rising part and are located on the outdoor side relative to the bottom wall, respectively; and a horizontal position of the projecting end of the projecting part is located substantially in the center of the outer surface of the rising wall in a horizontal direction.

2. The eaves gutter according to claim 1, wherein the eaves body and the rising part are structured as separate components, and, when the eaves body and the rising part are attached to the eaves edge, a slit is formed between the eaves body and the rising part to introduce rainwater into the recessed groove of the eaves body.

3. The eaves gutter according to claim 1, wherein an angle of inclination of the outer surface of the rising wall with respect to a horizontal plane is greater than an angle of inclination of the roof with respect to the horizontal plane.

4. The eaves gutter according to claim 2, wherein an angle of inclination of the outer surface of the rising wall with respect to a horizontal plane is greater than an angle of inclination of the roof with respect to the horizontal plane.

* * * * *